US008312699B2

(12) United States Patent
Cook

(10) Patent No.: US 8,312,699 B2
(45) Date of Patent: Nov. 20, 2012

(54) HORSEBACK RIDING SPUR MECHANISM

(75) Inventor: Karl Cook, Woodside, CA (US)

(73) Assignee: Karl Cook, Woodside, CA (US)

( * ) Notice: Subject to any disclaimer, the term of this patent is extended or adjusted under 35 U.S.C. 154(b) by 29 days.

(21) Appl. No.: 12/910,545

(22) Filed: Oct. 22, 2010

(65) Prior Publication Data

US 2011/0252754 A1 Oct. 20, 2011

Related U.S. Application Data

(60) Provisional application No. 61/324,883, filed on Apr. 16, 2010.

(51) Int. Cl.
*A43C 17/00* (2006.01)

(52) U.S. Cl. ..... 54/83.1

(58) Field of Classification Search ..... 54/49.5, 54/83.1, 83.2; 36/74; 182/221
See application file for complete search history.

(56) References Cited

U.S. PATENT DOCUMENTS

| | | | | |
|---|---|---|---|---|
| 376,832 | A | 1/1888 | Schummel | |
| 397,304 | A | 2/1889 | Nicholls | |
| 444,407 | A | 1/1891 | Bancroft | |
| 769,743 | A | 1/1904 | Hanaway | |
| 934,559 | A | 9/1909 | Monier | |
| 987,905 | A | 3/1911 | Monier | |
| 1,057,620 | A | 4/1913 | Copely | |
| 1,182,344 | A | 5/1916 | Buermann | |
| 4,302,028 | A * | 11/1981 | Svoboda | 280/631 |
| 2002/0108357 | A1 | 8/2002 | Martin | |

FOREIGN PATENT DOCUMENTS

| | | | |
|---|---|---|---|
| DE | 29913729 | U1 | 3/2000 |
| DE | 20 2004 002 629 | U1 | 5/2004 |
| FR | 454606 | A | 7/1913 |
| GB | 189827432 | A | 0/1899 |
| JP | H05-68312 | U | 9/1993 |

OTHER PUBLICATIONS

PCT International Search Report and Written Opinion for Application No. PCT/US2010/054032 mailed Feb. 10, 2011 (9 pages).
PCT International Search Report and Written Opinion for Application No. PCT/US2010/054002 mailed Feb. 10, 2011 (9 pages).

* cited by examiner

*Primary Examiner* — Rob Swiatek
*Assistant Examiner* — Lisa Tsang
(74) *Attorney, Agent, or Firm* — Osha Liang LLP

(57) ABSTRACT

A spur attachable to a boot. The spur includes a body having a first arm, a second arm, and a neck. A first bar having eyelets is attached to a distal end of the first arm and a second bar having eyelets is attached to a distal end of the second arm. The first arm and the second arm are configured to be forward relative to a heel of the boot and the neck is configured to be rearward relative to the heel of the boot.

9 Claims, 7 Drawing Sheets

HORSEBACK RIDING SPUR MECHANISM

CROSS-REFERENCE TO RELATED APPLICATIONS

The present application claims benefit under 35 U.S.C. §119(e) of the priority date of the provisional patent application with U.S. Application Ser. No. 61/324,883, filed on Apr. 16, 2010, in the United States of America, the entire contents of which are incorporated herein by reference. Further, this application is related to copending U.S. patent application Ser. No. 12,910,450, filed on the same date as the present document and entitled "Horse Riding Spur Mechanism," the entire contents of which are incorporated herein by reference. The referenced applications are in the name of and owned by the same inventor.

BACKGROUND

Traditional horseback riding spurs are formed in a substantially "c" shape, such that they may fit around the heel of a boot. The spur may include a body, which may have a neck (the part that may contact a horse) and arms (which may allow for attachment to a boot by straps).

SUMMARY

In one aspect, the present disclosure relates to a spur attachable to a boot. The spur includes a body having a first arm, a second arm, a third arm, a fourth arm, and a neck and a buckle disposed on the distal end of each arm, in which the arms are configured to be forward relative to a heel of the boot and the neck is configured to be rearward relative to the heel of the boot, and in which the third arm and fourth arm are configured to tighten a single strap attached to the buckles when the neck drops relative to the boot.

In another aspect, the present disclosure relates to a spur attachable to a boot. The spur includes a body having a first arm, a second arm, and a neck, a first bar comprising eyelets and attached to a distal end of the first arm, a second bar comprising eyelets and attached to a distal end of the second arm, in which the first arm and the second arm are configured to be forward relative to a heel of the boot and the neck is configured to be rearward relative to the heel of the boot.

BRIEF DESCRIPTION OF DRAWINGS

Features of the present disclosure will become more apparent from the following description in conjunction with the accompanying drawings.

DETAILED DESCRIPTION

During the use of spurs, either during riding or while walking when off of a horse, a spur that may be attached to the heel of a boot may slide and/or fall such that it may become ineffective and/or a nuisance to the user.

Figure 1A:
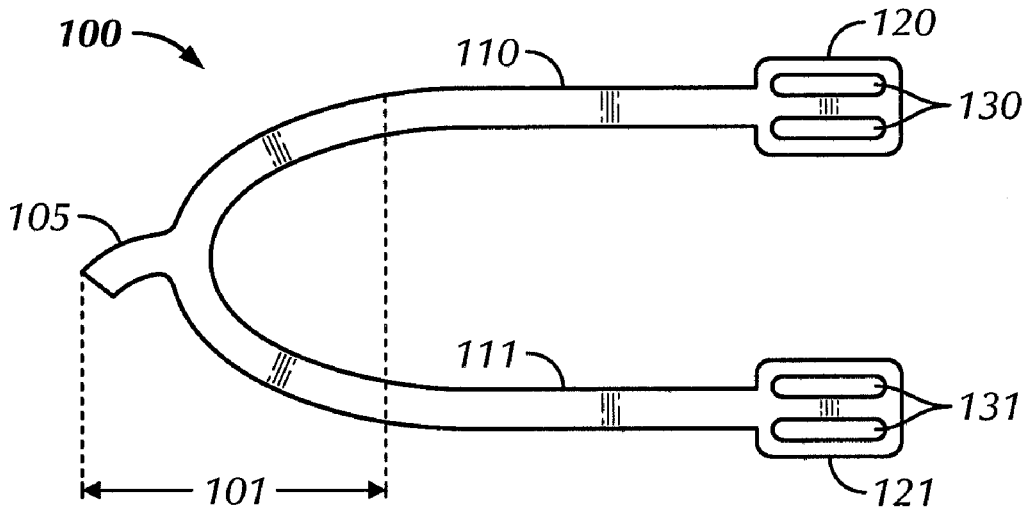
FIG. 1A (Prior Art)
FIG. 1A shows a perspective view and FIG. 1B shows a side view of a traditional spur.
Figure 1B:
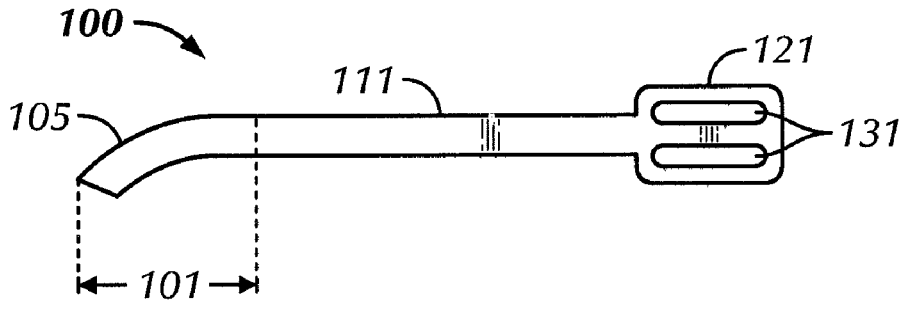
FIG. 1B (Prior Art)

Referring to FIGS. 1A and 1B, a traditional spur 100 is shown. Spur 100 may have a body 101 including a neck 105 and arms 110 and 111 extending therefrom. Body 101 may form a bell-shaped yoke such that neck 105 may be located at a "back" of spur 100, and arms 110 and 111 may extend in a "forward" direction. Neck 105 may be a removable and/or interchangeable neck that may include a threaded connection (not shown). The threaded connection may allow for different types of necks, such as shanks and/or rowels, to be installed on spur 100.

Spur 100 may be attached to a boot (see, FIG. 2), and, as defined herein, the backward and forward directions are in relation to the heel of the boot. Spur 100 may be made of aluminum, iron, brass, steel, plastic and/or any other suitable metal and/or material.

Figure 2:
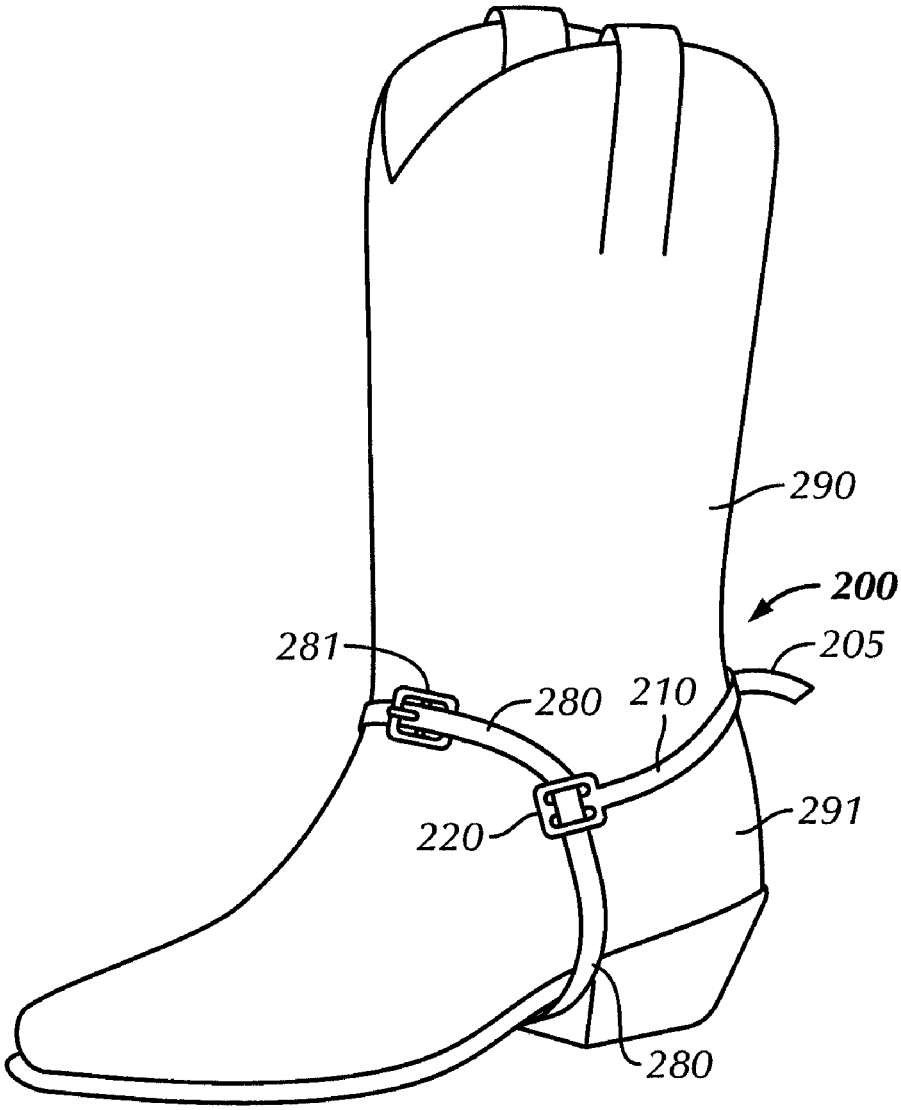
FIG. 2 (Prior Art)
FIG. 2 shows a traditional spur attached to a boot.

The spur may be attached to the heel of a boot by use of a strap or straps that may be wound through eyelets of the spur (see FIG. 2). Heads 120 and 121 may be located at the front end of arms 110 and 111, respectively. A strap may be wound through heads 120 and 121, extending around a circumference of the boot. Heads 120 and 121 may be provided with pairs of eyelets 130 and 131, respectively. Each pair of eyelets 130 and 131 may allow for the strap to be wound through heads 120 and 121, thereby attaching spur 100 to a boot.

Now, referring to FIG. 2, a spur 200 is shown attached to a boot 290. Spur 200 may have a neck 205 and an arm 210. A second arm (not shown) may be on the other side of boot 290. As noted above, neck 205 may be at the back of spur 200, such that neck 205 is rearward in relation to a heel 291 of boot 290. Arm 210 may extend in a forward direction in relation to heel 291 of boot 290.

As shown in FIG. 2, spur 200 may be attached to boot 290 by a strap 280 that may extend over the top of boot 290 and, also, may extend beneath boot 290 wrapping a complete circumference of boot 290. Accordingly, strap 280 may be a continuous length of leather, or other suitable material, that may be looped around boot 290 to thereby secure spur 200 to boot 290. In order to secure strap 280 and spur 200 to boot 290, a buckle 281 may be attached to a first end of strap 280. Buckle 281 may be a metallic buckle that may be securely attached to strap 280 at the first end, and may connect to a second end of the strap 280 by a bar placed through holes of strap 280 (not shown). Further, spur 200 may be held onto boot 290 by strap 280 that may be fed through eyelets (not shown) of head 220.

As a result of a single head, and, as such, the location of the eyelets, at the forward end of a spur, a single pivot point for the spur may exist. Accordingly, if any slack or looseness may exist in the strap, the neck of the spur may drop relative to the boot. In the event the spur may drop, the spur may become entangled on items or may not sit properly on the boot so that the spur may not be as effective.

Figure 3A:
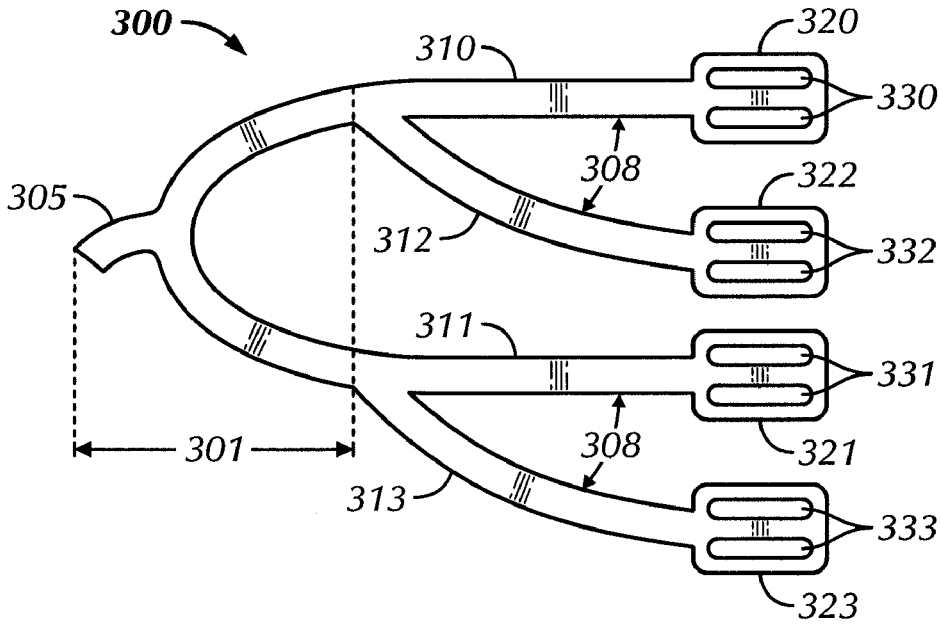
FIG. 3A shows a perspective view and FIG. 3B shows a side view of a spur in accordance with one or more embodiments of the present disclosure.
Figure 3B:
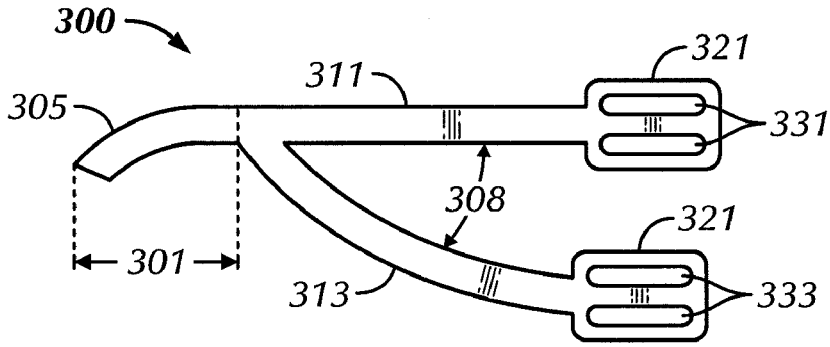

Referring now to FIGS. 3A and 3B, a modified spur in accordance with one or more embodiments of the present disclosure is shown. FIG. 3A is a perspective view of spur 300 and FIG. 3B is a side view of spur 300.

Similar to spur 200, spur 300 may have a body 301 with a neck 305 and arms 310 and 311 extending therefrom. At the forward end of arms 310 and 311 may be heads 320 and 321, respectively. Heads 320 and 321 may have pairs of eyelets 330 and 331, respectively, so that a strap (not shown) may be fed therethrough, as described above. Spur 300 may also include a second pair of arms 312 and 313 extending forward from body 301. Arm 312 may extend in a downward direction at an angle 308 from arm 310. Angle 308 may be any angle that may allow for arm 312 to extend head 322 to a lower position than head 320, relative to the boot to which spur 300 may attach. Furthermore, angle 308 may vary depending on a rider's foot and/or boot size. A corresponding arm 313 may extend downward from arm 311 at the same angle 308. Arms 312 and 313 may be made of the same material as spur 300 and the complete spur may be formed as a single body or arms 312 and 313 may be added separately by welding and/or any other means of attachment. Alternatively, arms 312 and 313 may extend in upward directions at an angle from arms 310 and 311, respectively.

Figure 4:
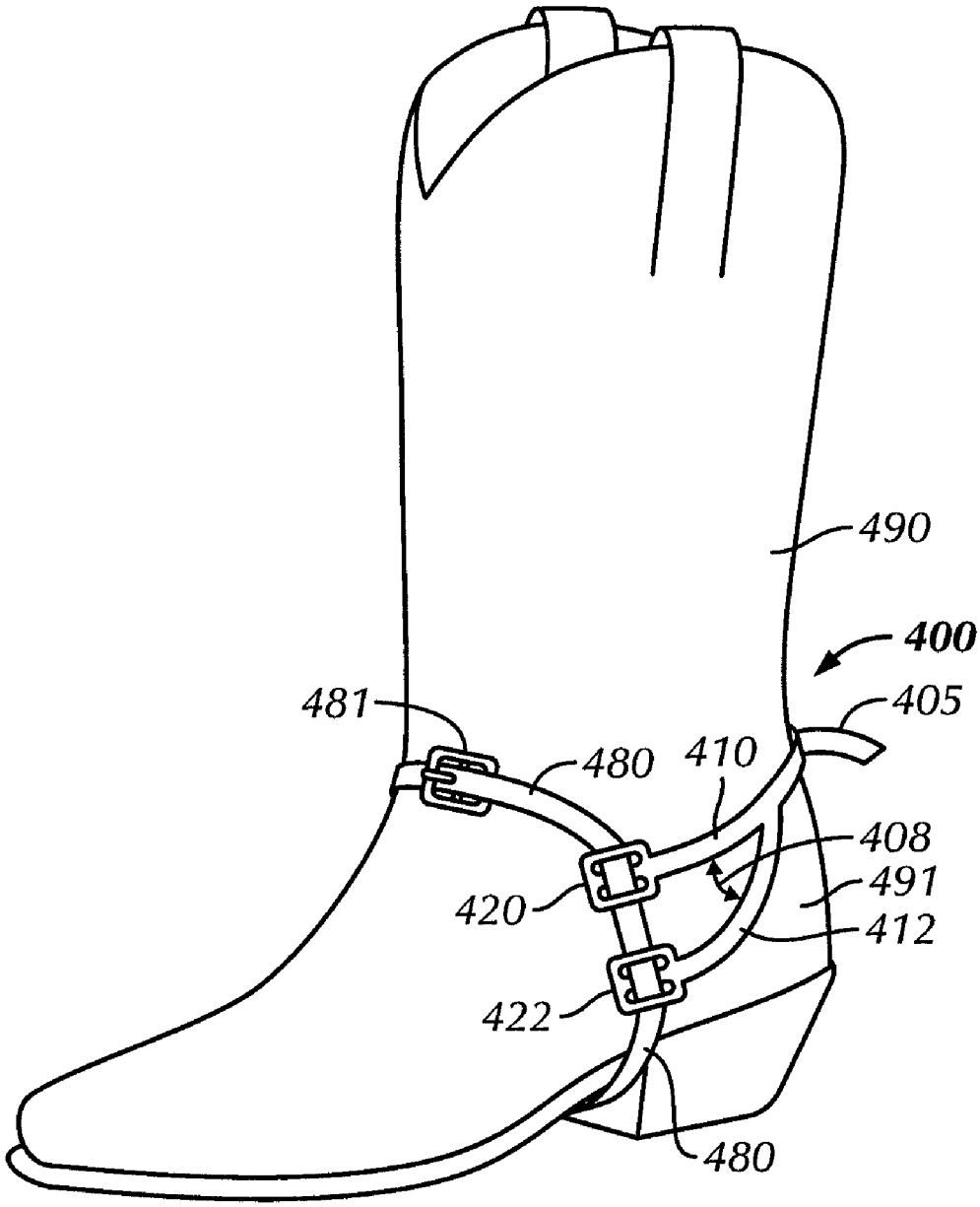
FIG. 4 shows a spur in accordance with one or more embodiments of the present disclosure attached to a boot.

Now referring to FIG. 4, spur 400 is shown attached to a boot 490. Spur 400 may be similar to spur 300 and may include a neck 405, a first arm 410, and a second arm 412. Arm 412 may extend downward from arm 410 at an angle 408. Spur 400 may be attached to boot 490 by a strap 480. Strap 480 may be fed through heads 420 and 422 of arms 410 and 412, respectively. Strap 480 may wrap around boot 490, and lock in place with buckle 481, as described above.

As arms 410 and 412 may be separated by angle 408, arms 410 and 412 may prevent spur 400 from falling in a downward direction towards heel 491 of boot 490. Arms 410 and 412 may allow for strap 480 to tighten in the event that neck 405 of spur 400 may fall in a downward direction thus preventing spur 400 from falling. Heads 420 and 422 may provide two points of contact with strap 480 such that a tightening of strap 480 may prevent neck 405 from falling in a downward direction.

Figure 5:
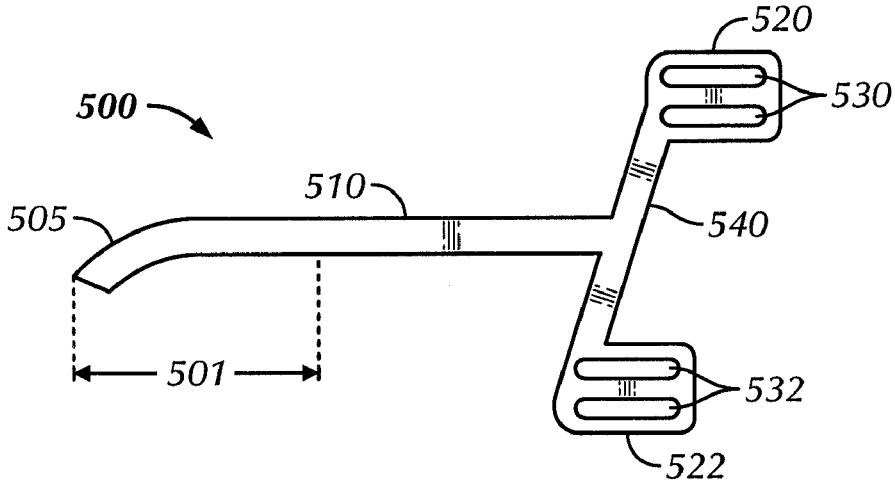
FIG. 5 shows a side view of a spur in accordance with one or more embodiments of the present disclosure.
Figure 6:
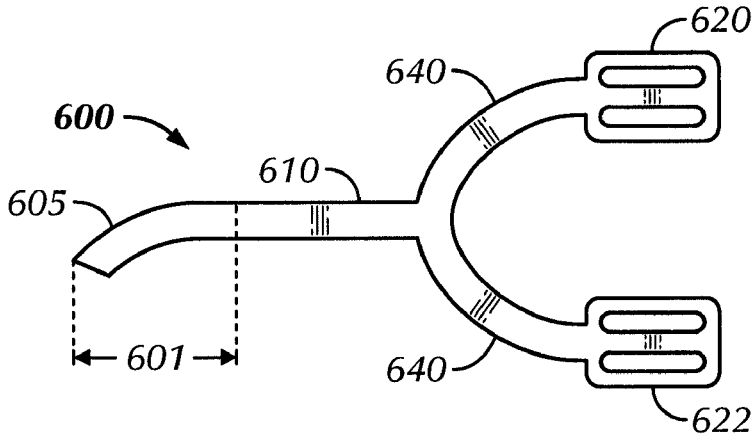
FIG. 6 shows a side view of a spur in accordance with one or more embodiments of the present disclosure.
Figure 7:
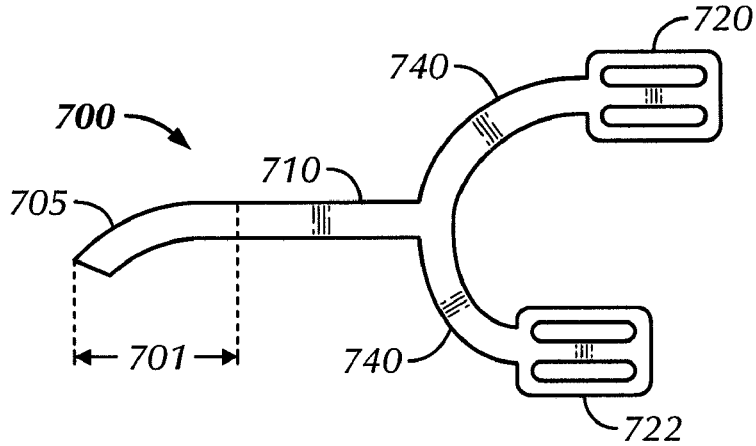
FIG. 7 shows a side view of a spur in accordance with one or more embodiments of the present disclosure.

FIGS. 5-7 show side views of alternative embodiments of spurs in accordance with the present disclosure.

Referring to FIG. 5, spur 500 is shown. Spur 500 may have a body 501 with a neck 505 at a rear end and an arm 510 extending in a forward direction. Arm 510 may have a bar 540 disposed on a forward end thereof. Bar 540 may allow for two heads 520 and 522 to be located at the side of a boot to which spur 500 may be attached. Heads 520 and 522 may provide similar support to that described above, as a strap (not shown) may be fed through eyelets 530 and 532 of heads 520 and 522, respectively. Although spur 500 is shown with bar 540 disposed at an offset angle such that bar 540 is not perpendicular to arm 510, those skilled in the art will appreciate that bar 540 may be set and/or placed at any angle with respect to arm 510, including bar 540 being perpendicular to arm 510.

Referring to FIG. 6, spur 600 is shown. Spur 600 may have a body 601 with a neck 605 at a rear end thereof and a forward extending arm 610. Arm 610 may have a bar 640 disposed on a forward end thereof, with heads 620 and 622 located at the distal ends of bar 640. Bar 640 may be a curved bar such that bar 640 may have two sections, one section curved upward, with relation to a boot that spur 600 may be attached, and one section that may be curved downward, as shown. Accordingly, bar 640 may be substantially "C" shaped. Further, although spur 600 is shown as a "C" shape, those skilled in the art will appreciate that bar 640 may incorporate straight sections, such that bar 640 forms a substantially "Y" and/or "V" shape, without deviating from the scope of the present disclosure.

Although spur 600 is shown with bar 640 providing upward and downward sections of equal length, the sections may be of variable length. FIG. 7 shows spur 700 with a body 701 and a neck 705. An arm 710 may extend forward from body 701 and a bar 740 may be located at the forward end of arm 710. Bar 740 may be curved, as shown, with an upper section of bar 740 longer than a lower section of bar 740. Accordingly, an offset may exist between the location of heads 720 and 722 located on the distal ends of bar 740. Further, those skilled in the art will appreciate that the upper and lower sections of bar 740 may be of variable length, and may have curvature and/or angles of inclination varied from that shown, without deviating from the scope of the present disclosure.

Figure 8:
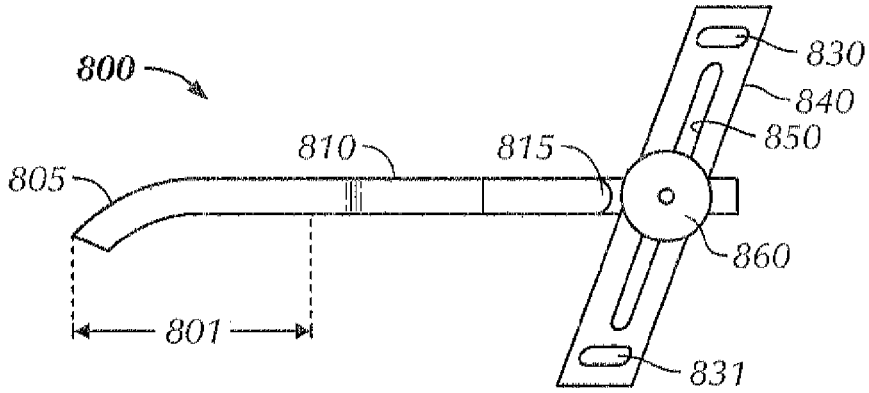
FIG. 8 shows a side view of a spur in accordance with one or more embodiments of the present disclosure.

Now referring to FIG. 8, a spur 800 in accordance with one or more embodiments of the present disclosure is shown. Spur 800 may have a body 801 with a neck 805 extending rearward and a forward extending arm 810 with a bar 840 located at the forward end of arm 810. Bar 840 of spur 800 may include eyelet 830 and eyelet 831 on ends of bar 840. Eyelets 830 and 831 may be separated by a rail 850 running through the middle of bar 840. Bar 840 may also be attached to arm 810 by a locking mechanism 860. Further, bar 840 may be removable and/or adjustable with respect to arm 810. Bar 840 may be rotatable about locking mechanism 860, such that bar 840 may be oriented in a forward leaning direction, a rearward leaning direction, or may be perpendicular to arm 810. A stop 815 may be provided to prevent bar 840 from rotating too far in any direction and may provide for stability to bar 840.

Figure 9A:
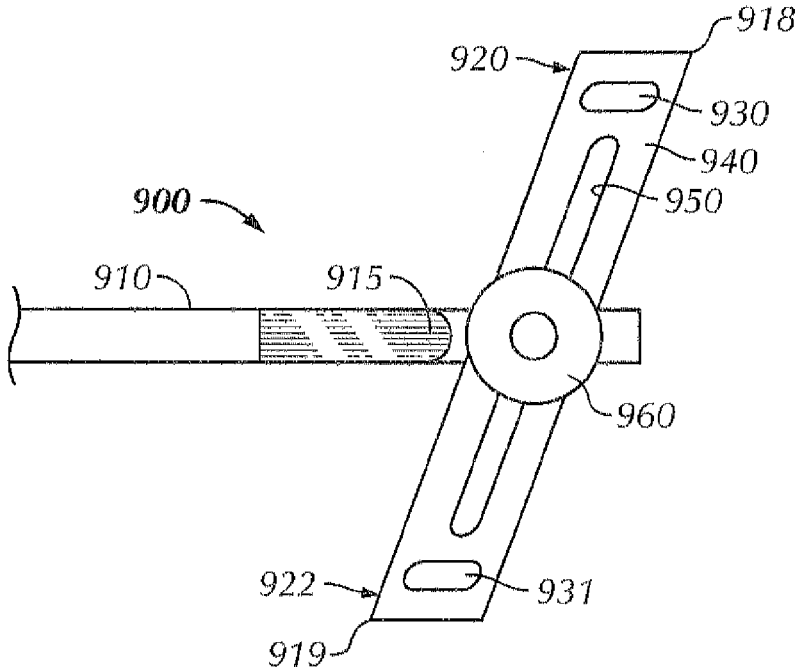
FIG. 9A shows a partial side view of a spur in accordance with one or more embodiments of the present disclosure.
Figure 9B:
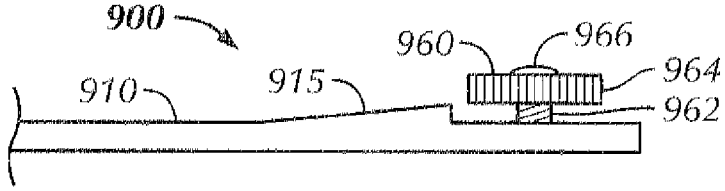
FIG. 9B shows a top view of the spur of FIG. 9A.

Referring now to FIGS. 9A and 9B, a detailed view of bar 940 and locking mechanism 960 of spur 900 is shown. FIGS. 9A and 9B show only the forward end of arm 910, and the rest of spur 900 is similar to that described above, particularly, the complete structure of spur 900 is similar to that shown in FIG. 8.

Bar 940 may include first end 918, first head 920 disposed near first end 918, second end 919, and second head 922 disposed near second end 919. Further, bar 940 may include a single pair of eyelets—an upper eyelet 930 disposed on the first head 920 and a lower eyelet 931 disposed on the second head Eyelets 930 and 931 may allow for a strap (not shown) to be fed through eyelet 930 at the top of bar 940, drawn over bar 940 and a rail 950 defining an interior of head 920, and then fed through eyelet 931 at the bottom of bar 940. Accordingly, the strap may cover bar 940. Alternatively, a strap may be fed in the opposite direction, as on the other side of a boot to which spur 900 may be attached. Accordingly, a strap may be fed through eyelet 931 at the bottom of bar 940 first, be drawn over bar 940, and then fed through eyelet 930 at the top of bar 940.

As noted, bar 940 may be adjustable along a rail 950 that may define an interior opening of bar 940. Rail 950 may allow bar 940 to be adjusted vertically along rail 950 and may allow for bar 940 to be rotated about a pivot point that may be a threaded shaft 962. Threaded shaft 962 may be part of a locking mechanism 960 that may include threaded shaft 962 (shown in FIG. 9B), a threaded nut 964, and a cap 966. Particularly, bar 940 may be locked into place by threaded nut 964 and cap 966 of locking mechanism 960 so as to prevent bar 940 from sliding and/or moving along rail 950 and/or rotating about threaded shaft 962. Although locking mechanism 960 is described with a threaded shaft 962, a threaded nut 964, and a cap 966, those skilled in the art will appreciate that alternative locking mechanisms may be used without deviating from the scope of the present disclosure. For example, a smooth shaft may be provided and a snap and/or clipping mechanism may provide the locking mechanism, such as a pin lock. Further still, nut 964, cap 966, and/or any other locking mechanism may be removable or may be permanently affixed to shaft 962. Accordingly, bar 940 may be permanently affixed to spur 900 or may be removable from spur 900, thus allowing for the ability to change and/or replace bar 940.

Further, arm 910 of spur 900 may include a stop 915. Stop 915 may be a portion of arm 910 that may prevent bar 940 from fully rotating about threaded shaft 962. As shown, stop 915 may be a tapered surface with a largest thickness at a forward end of arm 910 and thinning as stop 915 tapers toward a neck (not shown) of spur 900. Stop 915 may also have a curved forward edge such that bar 940 may have a large arc of rotation. Alternatively, those skilled in the art will appreciate that stop 915 may have a vertical forward edge, or any other form and/or shape of stop may be used, without deviating from the scope of the present disclosure.

Moreover, although bar 940 is shown as angled in the shape of a parallelogram, those skilled in the art will appreciate that bar 940 may have alternative shapes and/or angles, without deviating from the scope of the present disclosure. For example, a bar of rectangular shape may be employed. Furthermore, arcuate bars, similar in shape to that shown in FIGS. 6 and 7 may be employed without deviating from the scope of the present disclosure. Further, those skilled in the art will appreciate that bar 940 may have two sets of eyelets, similar to that shown in FIGS. 3-7, without deviating from the scope of the present disclosure.

Figure 9C:
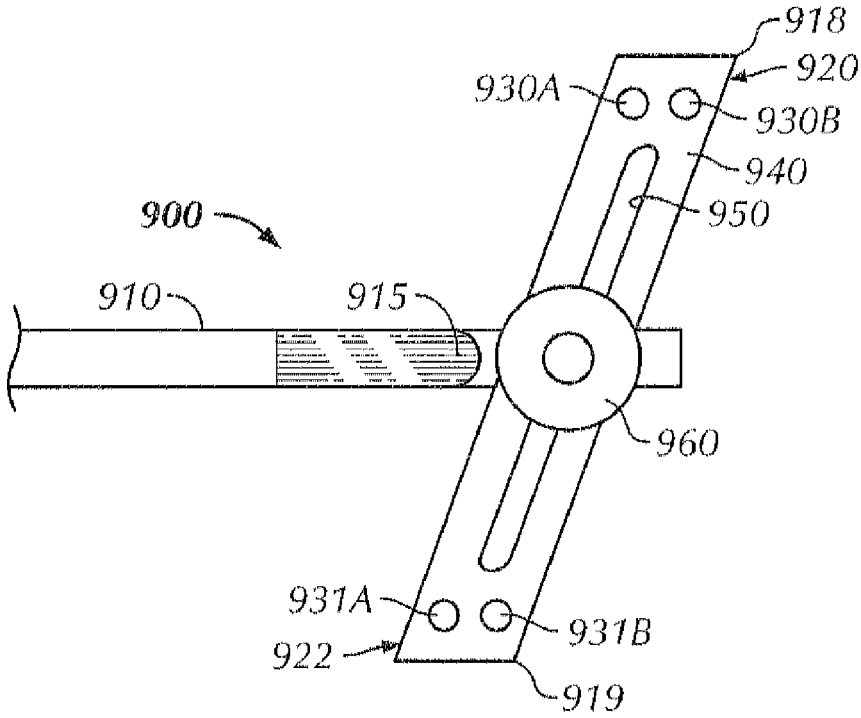
FIG. 9C shows a partial side view of a spur in accordance with one or more embodiments of the present disclosure, the spur having a pair of upper eyelets disposed on a first head and a pair of lower eyelets disposed on a second head.

Referring now to FIG. 9C, a detailed view of bar 940 and locking mechanism 960 of spur 900 is shown. FIG. 9C shows only the forward end of arm 910, and the rest of spur 900 is similar to that described above, particularly, the complete structure of spur 900 is similar to that shown in FIG. 8.

Bar 940 may include first end 918, first head 920 disposed near first end 918, second end 919, and second head 922 disposed near second end 919. Further, bar 940 may include a pair of eyelets disposed on each of first head 920 and second head 922. The pair of eyelets disposed on each of first head 920 and second head 922 may include upper eyelets 930A, 930B and lower eyelets 931A, 931B. Eyelets 930A, 930B, 931A, and 931B may allow for a strap (not shown) to be fed through eyelets 930A, 930B at the top of bar 940, drawn over bar 940 and a rail 950 defining an interior of head 920, and then fed through eyelets 931A, 931B at the bottom of bar 940. Accordingly, the strap may cover bar 940. Alternatively, a strap may be fed in the opposite direction, as on the other side of a boot to which spur 900 may be attached. Accordingly, a strap may be fed through eyelets 931A, 931B at the bottom of bar 940 first, be drawn over bar 940, and then fed through eyelets 930A, 930B at the top of bar 940.

As noted, bar 940 may be adjustable along a rail 950 that may define an interior opening of bar 940.

Further, arm 910 of spur 900 may include a stop 915. Stop 915 may be a portion of arm 910 that may prevent bar 940 from fully rotating about threaded shaft 962. As shown, stop 915 may be a tapered surface with a largest thickness at a forward end of arm 910 and thinning as stop 915 tapers toward a neck (not shown) of spur 900. Stop 915 may also have a curved forward edge such that bar 940 may have a large arc of rotation. Alternatively, those skilled in the art will appreciate that stop 915 may have a vertical forward edge, or any other form and/or shape of stop may be used, without deviating from the scope of the present disclosure.

Moreover, although bar 940 is shown as angled in the shape of a parallelogram, those skilled in the art will appreciate that bar 940 may have alternative shapes and/or angles, without deviating from the scope of the present disclosure. For example, a bar of rectangular shape may be employed. Furthermore, arcuate bars, similar in shape to that shown in FIGS. 6 and 7 may be employed without deviating from the scope of the present disclosure. Further, those skilled in the art will appreciate that bar 940 may have two sets of eyelets, similar to that shown in FIGS. 3-7, without deviating from the scope of the present disclosure.

Advantageously, spurs in accordance with one or more embodiments of the present disclosure may allow for a non-falling spur. Specifically, a spur in accordance with one or more embodiments of the present disclosure may prevent a loose strap from allowing a spur to drop relative to a heel of a boot to which the spur may be attached.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. A spur attachable to a boot, the spur comprising:

a body having a first arm, a second arm, and a neck;

a first bar comprising a first eyelet and a second eyelet and attached to a distal end of the first arm;

a second bar comprising a third eyelet and a fourth eyelet and attached to a distal end of the second arm;

a first interior rail formed through the first bar, the first rail interposed between the first eyelet and the second eyelet; and a second interior rail formed through the second bar, the second rail interposed between the third eyelet and the fourth eyelet, wherein the first arm and the second arm are configured to be forward relative to a heel of the boot and the neck is configured to be rearward relative to the heel of the boot.

2. The spur of claim 1, wherein at least one of the first bar and the second bar is moveably attached to the first or second arm.

3. The spur of claim 1, wherein at least one of the first bar and the second bar is rotatably attached to the first or second arm.

4. The spur of claim 3, further comprising: a support disposed on an exterior surface of the body and configured to stop the rotatably attached first bar.

5. The spur of claim 1, wherein the first interior rail and the second interior rail are both configured to allow the first bar and second bar to be adjusted along the interior rails.

6. The spur of claim 1, wherein the first bar comprises a first set of eyelets comprising the first eyelet and a second set of eyelets comprising the second eyelet, wherein the second bar comprises a third set of eyelets comprising the third eyelet and a fourth set of eyelets comprising the forth eyelet, and wherein the first set of eyelets is disposed on a first end of first bar, the second set of eyelets is disposed on a second end of the first bar, the third set of eyelets is disposed on a first end of the second bar, and the fourth set of eyelets is disposed on a second end of the second bar.

7. The spur of claim 6, wherein the first bar is a straight bar and the first bar attaches to the first arm at approximately the middle of the first bar.

8. The spur of claim 1, wherein at least one of the first eyelet and the second eyelet is disposed at a first end of the first bar and at least one of the first eyelet and the second eyelet is disposed at a second end of the first bar.

9. The spur of claim 8, wherein the eyelets are configured to receive a strap such that the strap may cover an exterior side of the first bar.

* * * * *